United States Patent [19]

Puerner

[11] Patent Number: 5,007,856

[45] Date of Patent: Apr. 16, 1991

[54] HOUSING FOR AN ELECTRICAL CONNECTION

[75] Inventor: Dean A. Puerner, Maricopa, Ariz.

[73] Assignee: AMP Incorporated, Harrisburg, Pa.

[21] Appl. No.: 454,259

[22] Filed: Dec. 21, 1989

[51] Int. Cl.[5] ..... H01R 13/58

[52] U.S. Cl. ..... 439/452; 439/465; 439/586; 439/498

[58] Field of Search ..... 439/492–499, 439/449, 452, 456, 460, 463, 465, 466, 467, 592, 596

[56] References Cited

U.S. PATENT DOCUMENTS

| | | | |
|---|---|---|---|
| Re. 31,336 | 8/1983 | Weinmann et al. | 29/868 |
| 3,336,564 | 8/1967 | McCaughey | 339/99 |
| 3,601,768 | 7/1989 | Lightner | 339/103 M |
| 3,854,787 | 12/1974 | Snyder, Jr. | 339/103 R |
| 4,221,352 | 9/1980 | Caveney | 248/74 PB |
| 4,428,638 | 1/1984 | Greenwood | 439/465 |
| 4,705,482 | 11/1987 | Endo et al. | 439/492 |
| 4,781,615 | 11/1988 | Davis et al. | 439/395 |
| 4,832,625 | 5/1989 | Puerner | 439/681 |
| 4,859,204 | 8/1989 | Daly et al. | 439/424 |
| 4,867,700 | 9/1989 | Kreinberg | 439/422 |
| 4,886,942 | 12/1989 | Lenz et al. | 439/449 |
| 4,887,977 | 12/1989 | Lemke | 439/497 |
| 4,902,241 | 2/1990 | Lockard | 439/395 |

FOREIGN PATENT DOCUMENTS

| | | | |
|---|---|---|---|
| 0087710 | 9/1983 | European Pat. Off. | 439/498 |
| 2233075 | 1/1974 | Fed. Rep. of Germany | 439/449 |
| 1014237 | 12/1965 | United Kingdom | 439/499 |

OTHER PUBLICATIONS

U.S. application Ser. No. 386,536, Puerner.

*Primary Examiner*—David L. Pirlot
*Attorney, Agent, or Firm*—Anton P. Ness

[57] ABSTRACT

Housings for terminations or interconnections of flat electrical cable have integral cable-clamping means to compensate for variations in cable thickness at cable exits and can accommodate one or two cables at an exit. The cable-clamping means are integral cable-engaging platforms which upon cable surface engagement as the pair of housings are secured together, are deflectable against spring bias into respective transverse relief slots therebehind. The cable-engaging platforms remain in compression against the one or two cables at the cable exit and provide insulation, vibration resistance and strain relief, protecting the termination or interconnection site.

6 Claims, 4 Drawing Sheets

24
16
10
22
52
20
36
50
12
34
42
44
26
38
28
40
14
54
20
46
22
18
24

HOUSING FOR AN ELECTRICAL CONNECTION

FIELD OF THE INVENTION

The present invention relates to the field of electrical connections and more particularly to housings for electrical terminations and interconnections of flat cable.

BACKGROUND OF THE INVENTION

U.S. Pat. Nos. 4,859,204; 4,867,700; 4,915,650 and 4,900,264 disclose electrical terminations of terminals to ends of flat power cable, and interconnections between respective flat power cables. The cable is of the type entering commercial use for transmitting electrical power of for example 75 amperes nominal, and includes a flat conductor one inch wide and about 0.020 inches thick with an extruded insulated coating of about 0.0004 to 0.008 inches thick over each surface with the cable having a total thickness averaging about 0.034 inches. The cable could also have a pair of parallel spaced coplanar flat conductors having insulation extruded therearound and therebetween, defining power and return paths for electrical power transmission. Similar cable could have a thinner conductor members and have a total thickness of about 0.017 inches.

In U.S. patent application Ser. Nos. 4,900,264 and 07/454,656 filed Dec. 21, 1989, are disclosed electrical interconnections of one dual conductor flat power cable to another, forming a splice or tap interconnection between the cables which mechanically joins the cables and electrically interconnects the respective ones of the pairs of cable conductors. The cables are first stacked in parallel one atop the other, with the ones of the conductors of each cable to be interconnected being adjacent each other. In certain embodiments thereof a main cable and a tap cable exit one end of the interconnection, while only the main cable exits the opposed end; thus there are two cable thicknesses exiting one end while only one cable thickness exits the other end It is desired that the housing means be adapted to compensate for one or two cable thicknesses, and also for variations in the thicknesses of each cable, within a limited range of thicknesses.

It is desired that the housing means structurally engage the opposed major cable surfaces at the cable exits at all thicknesses of exiting cable within the range.

It is further desired that the engagement be under compression to provide strain relief benefits.

SUMMARY OF THE INVENTION

The present invention is a housing means enclosing the termination of a terminal to an end of a flat power cable, or enclosing the terminal structure interconnecting conductors of a pair of flat cables. The housing means includes resilient cable-clamping means integral therewith for engaging major side surfaces of one or two substantially wide cables exiting from the termination or interconnection site. The cable-clamping means may preferably include a correspondingly wide cable-engaging platform deflectable outwardly against spring bias upon cable surface engagement into a relief slot therebehind. A pair of housing members may include opposed ones of such cable-engaging platforms deflectable outwardly into respective relief slots, when the housing members are secured together about the termination or interconnection site. For an interconnection site, the housing means has cable-clamping means at opposite ends for the two cable exits.

It is an objective of the present invention to provide a housing means which provides assured insulation at a cable exit from a termination or interconnection for at least a limited range of cable thicknesses at the cable exit.

It is a further objective that the housing means provides engagement with the major cable surfaces under compression, providing vibration resistance and cable strain relief and relief against lateral torque, protecting the termination or interconnection site.

It is also an objective to provide hermaphroditic housing members able to compensate for cable thickness variations.

Embodiments of the present invention will now be discussed with reference the accompanying drawings.

DETAILED DESCRIPTION OF THE PREFERRED EMBODIMENT

Figure 1:
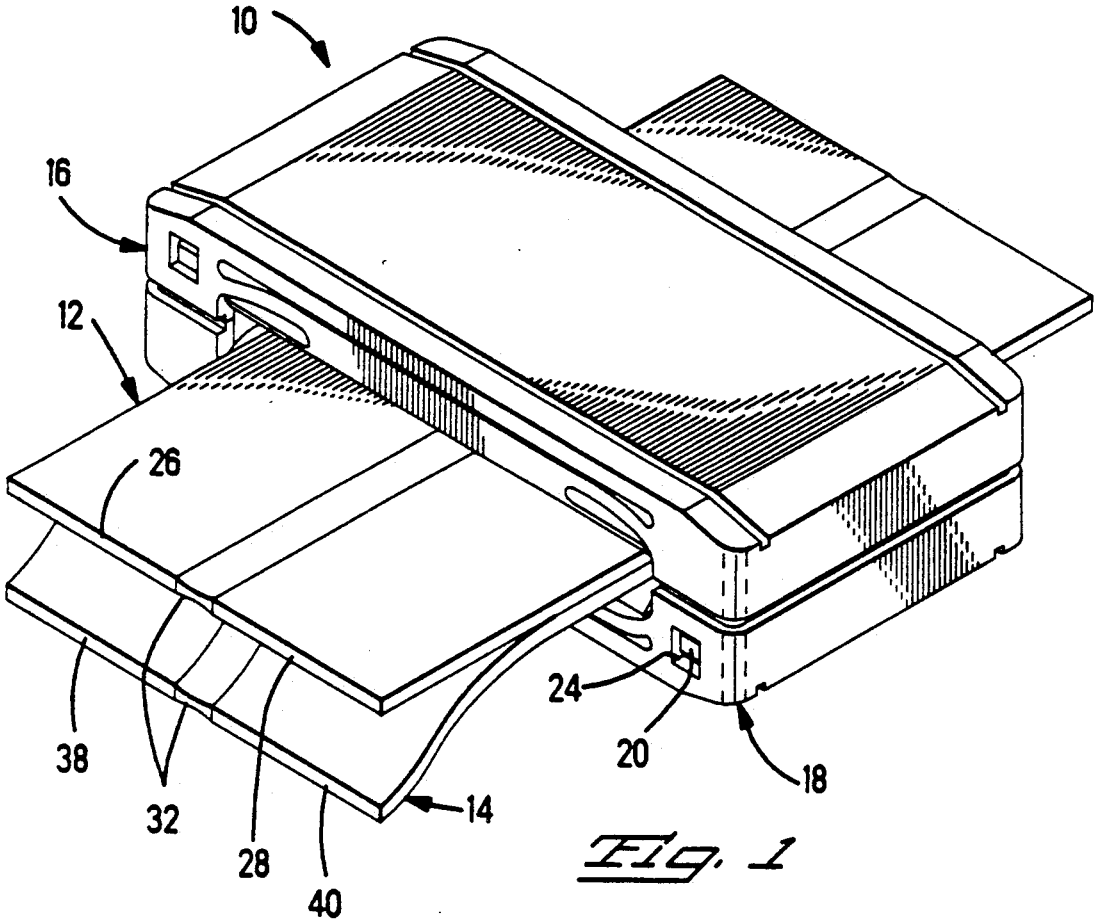
FIG. 1 is a perspective view of a completed, housed in-line tap connection between a main dual conductor flat power cable and a tap cable.
Figure 2:
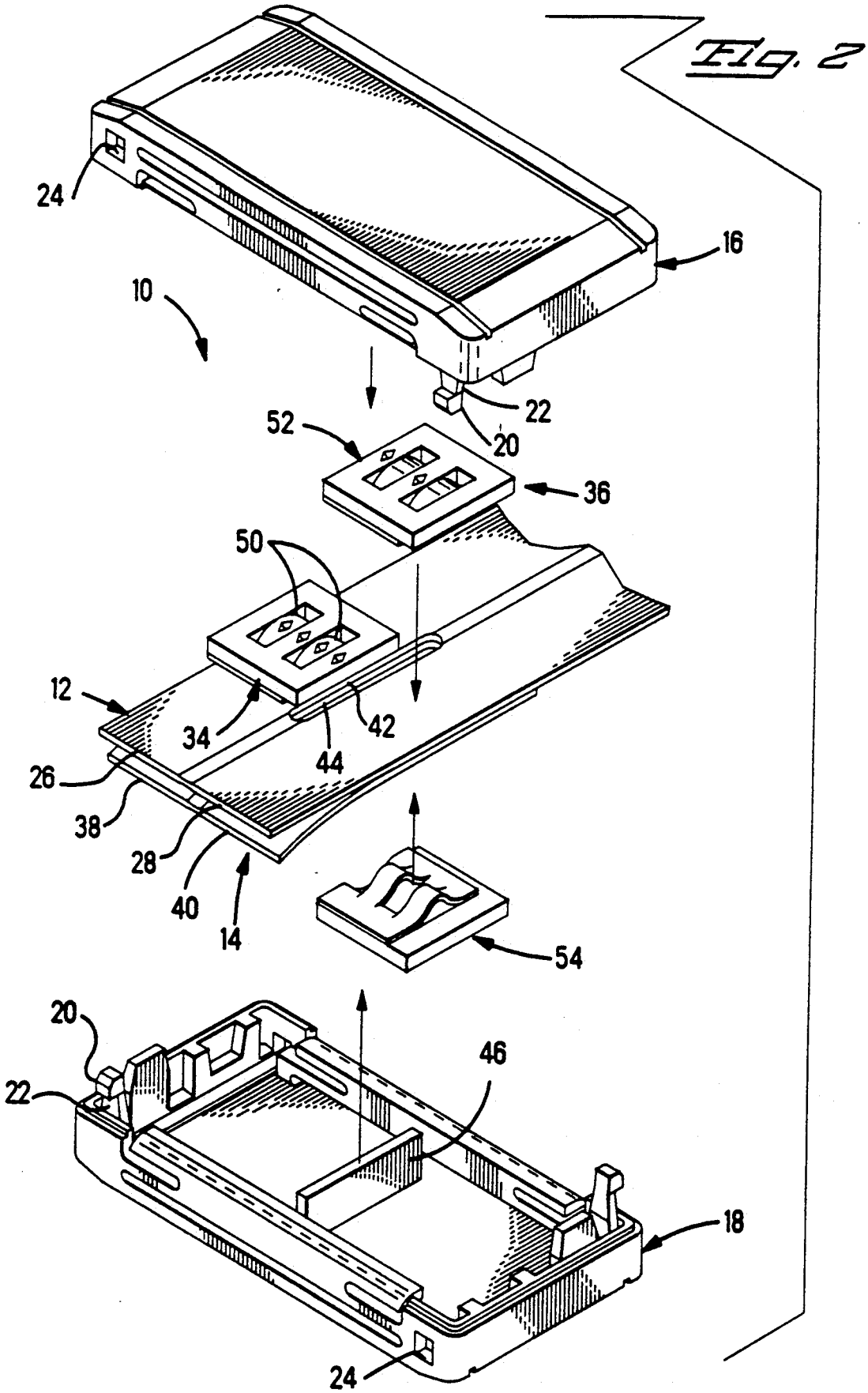
FIG. 2 is a perspective view of the tap connection of FIG. 1 with the housing members exploded from the tap connection, revealing one interconnecting structure interconnecting a respective pair of conductors of the main and tap cables, and upper and lower members of another like structure about to be terminated to the other pair of cable conductors.

FIGS. 1 and 2 illustrate an interconnection of a first flat power cable with a second such cable, which may be single or dual conductor; the interconnection shown is a tap connection 10 between a main dual conductor flat cable 12 and a tap cable 14 of similar construction. The interconnection of the present invention may also be used to splice together a pair of flat cables, and also for either tapping or splicing a pair of single conductor flat cables. The housing assembly can comprise dielectric upper and lower housing members 16,18 which are secured together to provide insulation, cable strain relief and physical protection of the cable interconnection site. Members 16,18 are shown securable together by latching projections 20 of latch arms 22 latchable with corresponding latching recesses 24 of the other housing member. Alternatively, housing members 16,18 may be securable together by means of posts (not shown) extending from at least one of the members toward the other at respective corners, being received force-fittably in post-receiving holes of the other, where the post-receiving holes include engaging ribs protruding into the holes which become deformed to firmly hold the posts in the holes, as disclosed in U.S. Pat. No. 4,781,615.

Figure 1A:
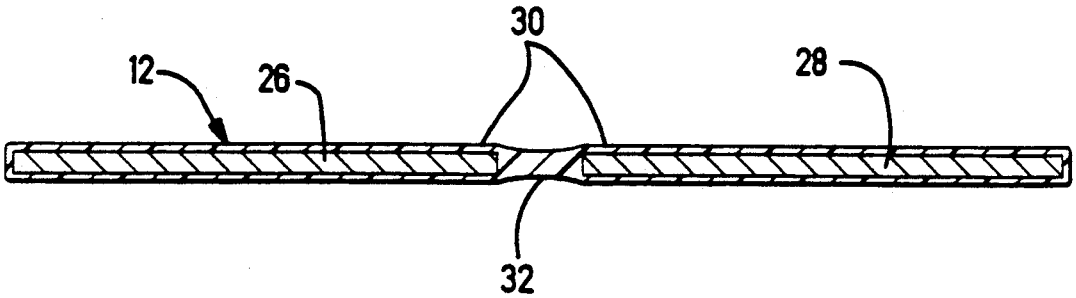
FIG. 1A is a cross-section of a dual conductor flat power cable of the type being interconnected.

FIG. 1A illustrates a typical cross-section of a dual conductor flat power cable 12 wherein a pair of flat conductors 26,28 have an insulative coating 30 extruded therearound and defining a medial strip 32 between the conductors; cable 14 has identical construction.

Figure 3:
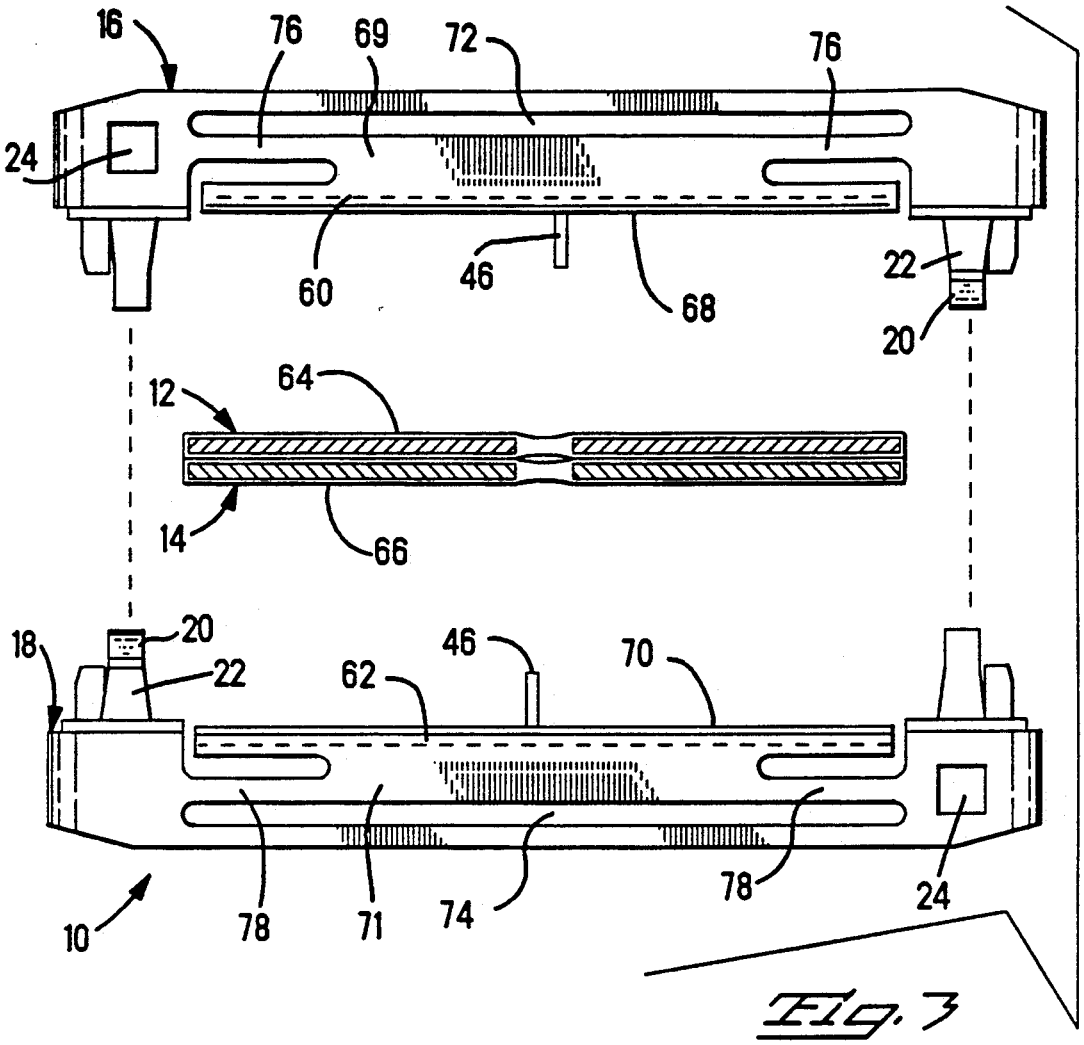
FIGS. 3 and 4 are end views of the housing members before and after being secured together about the cable interconnection site, with a pair of cables exiting the site.
Figure 4:
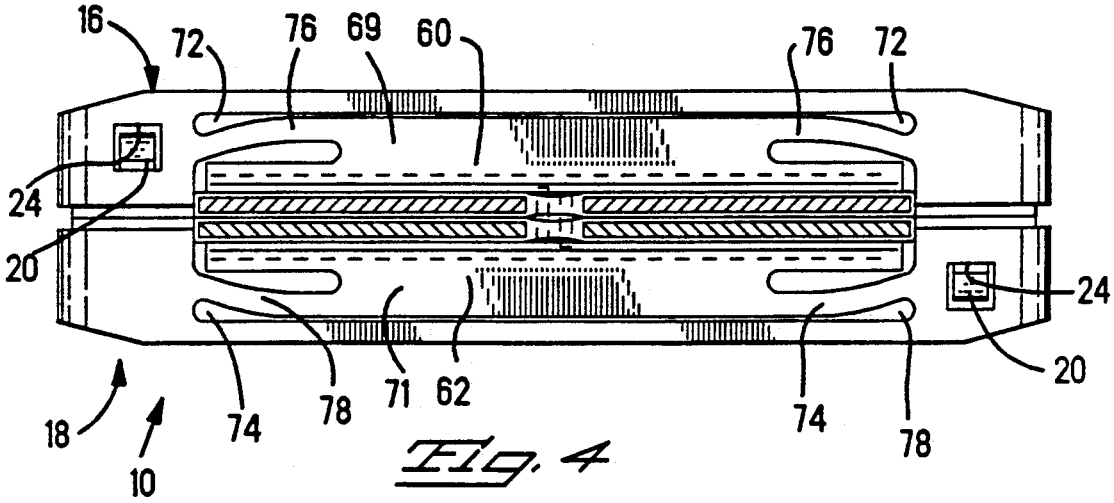

In FIG. 2 two interconnecting structure assemblies 34,36 are shown each of which interconnects respective ones of the conductors of the main and tap cables, while sandwiching both cables therewithin. Assembly 34 electrically interconnects conductor 26 of main cable 12 with conductor 38 of tap cable 14. Assembly 36 will electrically interconnect conductors 28,40 when upper and lower structures 52,54 are pressed together against the cables. Cables 12,14 are previously prepared for termination by having punched therethrough vertically aligned elongate slots 42,44 therethrough along the medial strips thereof, removing at least most of the width of the medial strips. Medial slots 42,44 permit an axially extending barrier wall 46 of the housing members 16,18 to extend therethrough providing dielectric material between the interconnecting structures 34,36 after termination to assure electrical isolation of the circuits after interconnection. Barrier wall 46 may comprise respective wall sections of both members 16,18 slightly offset from center to permit passing by each other during assembly of housing members 16,18 about the interconnection site (FIGS. 3 and 4). Slots 42,44 also enable registration tooling of the termination apparatus (not shown) to accurately locate and hold the cables in position during termination. The interconnections occur at sides of each of a plurality of alternating upper and lower wave joints, upper wave joints 50 being visible in the Figure. Alternatively, as described in Serial No. 07/454,656 the slots may be punched during termination, simultaneously with removal of ligatures initially joining together the lateral sections of the upper structure and the lateral sections of the lower structure, respectively.

Housing members 16,18 are hermaphroditic to simplify inventory and assembly, and are shown in FIGS. 3 and 4 being assembled together to enclose terminated interconnection site 10. Cable-engaging sections 60,62 abut the adjacent outwardly facing surfaces 64,66 of the cable or cables 12,14 exiting from the ends of the interconnection site 10. Cable-engaging sections 60,62 are stiffly resilient spring biased clamps firmly holding cable or cables 12,14 therebetween: cable-engaging platforms 68,70 extend along cable-remote base portions 69,71 which are joined to side portions of housing members 16,18 by hinges 76,78. Upon engagement of the major cable surfaces 64,66 by cable-engaging platforms 68,70 the cable-remote base portions 69,71 are deflected into transverse relief slots 72,74 therebehind and remain integrally joined to housing members 16,18 by hinges 76,78 which are elastically deformable. Such housing members may be molded for example of thermoplastic material having heat resistant properties such as CELANEX 3112-2 PBT polyester resin sold by Celanese Plastics & Specialties Company, Chatham, N.J., or VALOX DR 48 resin sold by General Electric Company, Fairfield, Conn.

In this manner housing members 16,18 of tap connection 10 of the present invention may compensate for one cable thickness or two cable thicknesses, and also for a range of cable thicknesses of from about 0.014 to about 0.034 inches and still attain cable clamping for vibration resistance and strain relief benefits.

Figure 5:
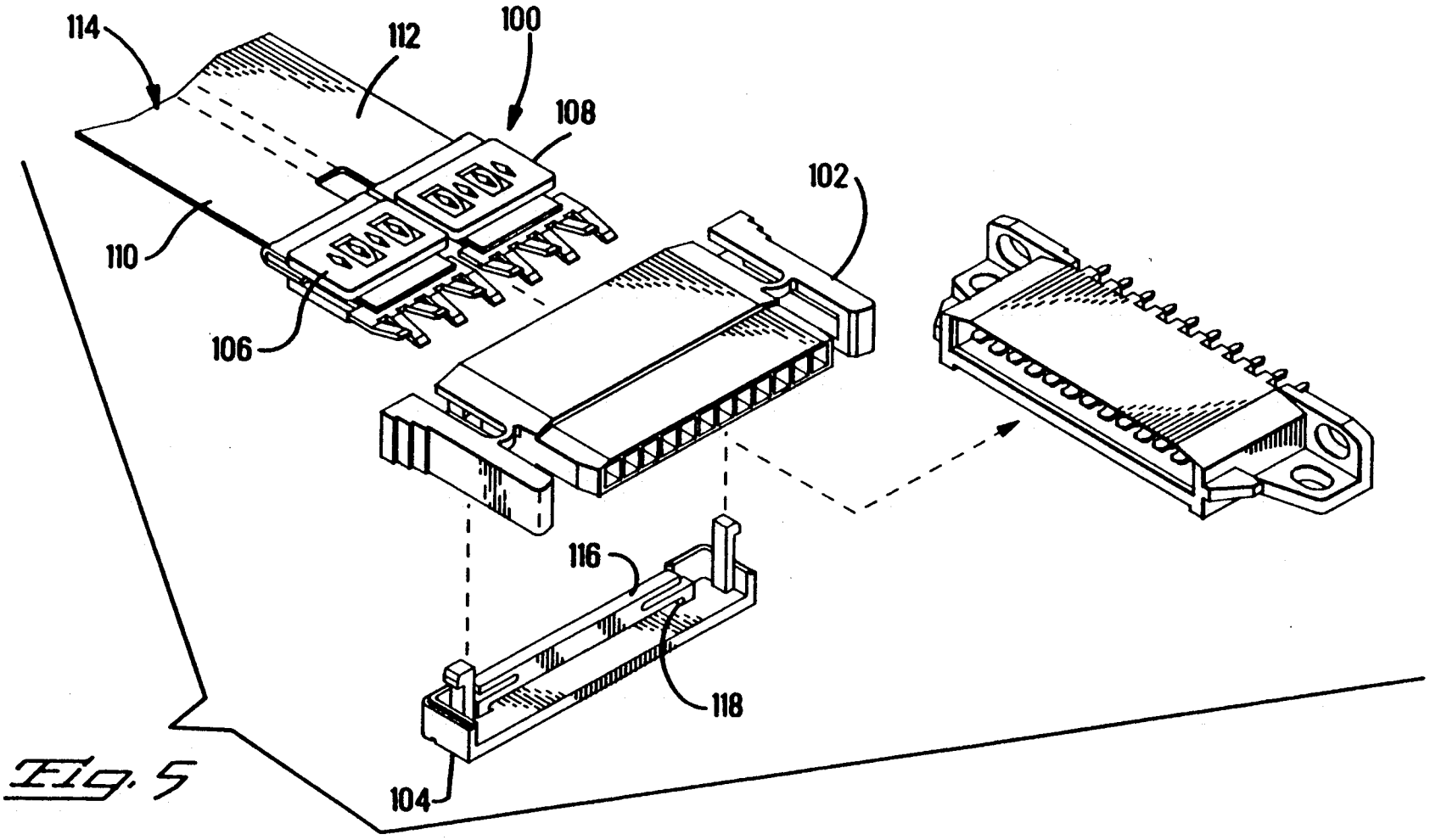
FIG. 5 is a perspective exploded view of a termination of a flat cable, showing a pair of terminals terminated to respective conductors of the cable, with a pair of housing members of the present invention.

In FIG. 5 is shown another embodiment of the present invention in which a pair of housing members 102,104 is used to provide a dielectric housing about a termination site 100 of a pair of terminals 106,108 to respective conductors 110,112 at an end of a flat cable 114. Cable-engaging platform 116 will engage and clamp against the lower major cable surface of cable 114 upon lower housing member 104 being secured to upper housing member 102 about the termination site. Platform 116 urges cable 114 against a surface of upper housing member 102 whereupon platform 116 is deflectable into slot 118 as the housing members latch together. Upper housing member 102 may also have a like deflectable platform, if desired, as with housings 16,18 in FIGS. 3 and 4.

Various modifications may be made to the housing means of the present invention which are within the spirit of the invention and the scope of the claims.

What is claimed is:

1. A housing means for enclosing a termination site of flat electrical cable of substantial width and defining a substantially wide exit for the cable from the site, comprising first and second housing members securable together about the termination site, at least one of said housing members including a resilient cable-clamping means integral therewith, said cable-clamping means being opposed from a cable-engaging portion of the other said cover member for firmly clamping major side surfaces of at least a first said cable extending from said termination site and defining a cable exit, each said first cable-clamping means including a cable-engaging platform having a cable-remote base portion joined by deformable hinges to side portions of said cover member laterally to each side of said cable exit, said cable-remote base portion being deflectable normally outwardly against spring bias into a relief slot therebehind upon said cover members being urged together and clamping against said cable major surfaces, the deflection resulting from elastic deformation of said hinges, providing insulative structure generally closing off the aperture but adjustable to variations in cable thickness at said first cable exit of the interconnection and providing vibration resistance for at least a limited range of cable thicknesses at the cable exit.

2. A housing means as set forth in claim 1 wherein said cable-engaging portions of said second housing member is a cable-clamping means integral therewith including a cable-engaging platform deflectable outwardly against spring bias upon cable engagement into a relief slot therebehind.

3. A housing means for enclosing an interconnection site of first and second flat cables of substantial width and enclosing and electrically insulating conductive structures for interconnecting portions of conductor means of said cables, said cables being stacked one atop the other and parallel to each other with at least a first said cable extending axially from the interconnection in a first direction, comprising:

first and second housing members and means for securing said first and second housing members to each other about said interconnection site, at least said first housing member including at least one first resilient cable-clamping means integral therewith, each said first cable-clamping means being opposed from cable-engaging portion of said second housing member for firmly clamping major side surfaces of said at least a first said cable extending from said interconnection and defining a first cable exit, each said first cable-clamping means including a cable-engaging platform and having a cable-remote base portion joined by deformable hinges to side portions of said cover member laterally to each side of said cable exit, said cable-remote base portion being deflectable normally outwardly against spring bias into a relief slot therebehind upon said cover members being urged together and clamping against said cable major surfaces, the deflection resulting from elastic deformation of said hinges, providing insulative structure generally closing off the aperture but adjustable to variations in cable thickness at said first cable exit of the interconnection and providing vibration resistance for at least a limited range of cable thicknesses at the cable exit.

4. A housing means as set forth in claim 3 wherein at least a second said cable extends axially from the interconnection in a second direction, and each said first housing member includes two said first cable-clamping means, both said cable-clamping means being opposed from respective cable-engaging portions of said second housing member for firmly clamping major side surfaces of said at least a first said cable at said first cable exit, and of said at least a second said cable extending from said interconnection and defining a second cable exit.

5. A housing means as set forth in claim 4 wherein said cable-engaging portions of said second housing member is a cable-clamping means integral therewith including a cable-engaging platform deflectable outwardly against spring bias upon cable engagement into a relief slot therebehind.

6. A housing means as set forth in claim 5 wherein said first and second housing members are hermaphroditic.

* * * * *